US008746265B2

(12) United States Patent
Nilsson et al.

(10) Patent No.: US 8,746,265 B2
(45) Date of Patent: Jun. 10, 2014

(54) FOLDABLE SEAT FOR A ROLLATOR OR A WHEELCHAIR

(75) Inventors: Tobias Nilsson, Ljungby (SE); Joseph Van Houtem, Grimslöv (SE)

(73) Assignee: Invacare International Sarl, Gland (CH)

( * ) Notice: Subject to any disclaimer, the term of this patent is extended or adjusted under 35 U.S.C. 154(b) by 0 days.

(21) Appl. No.: 13/530,756

(22) Filed: Jun. 22, 2012

(65) Prior Publication Data

US 2013/0061893 A1 Mar. 14, 2013

(30) Foreign Application Priority Data

Jun. 23, 2011 (EP) ..... 11171122

(51) Int. Cl.
*A61H 3/04* (2006.01)

(52) U.S. Cl.
USPC ..... 135/66; 297/42; 297/312

(58) Field of Classification Search
USPC ..... 135/66; 297/312, 42, 350, 5, 6, DIG. 4; 16/328, 331
See application file for complete search history.

(56) References Cited

U.S. PATENT DOCUMENTS 5,240,276 A * 8/1993 Coombs ..... 280/647
5,244,222 A * 9/1993 Benoit ..... 280/250.1
5,380,262 A * 1/1995 Austin ..... 482/68
6,241,275 B1 * 6/2001 Slagerman ..... 280/650
6,296,263 B1 * 10/2001 Schultz et al. ..... 280/87.021
7,108,004 B2 9/2006 Cowie
7,364,228 B2 * 4/2008 Entz ..... 297/44
8,083,252 B2 * 12/2011 Wagner et al. ..... 280/650
2005/0211285 A1 9/2005 Cowie

FOREIGN PATENT DOCUMENTS

EP 1060724 12/2000
EP 1244413 7/2004

OTHER PUBLICATIONS

EP11171122 Search Report, Jul. 11, 2011.

* cited by examiner

*Primary Examiner* — Noah Chandler Hawk
(74) *Attorney, Agent, or Firm* — Calfee, Halter & Griswold LLP

(57) ABSTRACT

A foldable seat for a rollator or a wheelchair includes a first plate and a second plate. The plates are rotatably moveable between an unfolded position and a folded position.

A hinge pivotally connects said first plate to said second plate. An exemplary hinge includes at least a first cylinder integral with said first plate and at least a second cylinder integral with said second plate.

The seat further includes a locking/unlocking system configured to be actuated by the user so as to lock, respectively unlock, said first and second plates into, respectively from, said unfolded position and/or said folded position. The locking/unlocking system being at least partially lodged inside said first and/or said second cylinder.

26 Claims, 6 Drawing Sheets

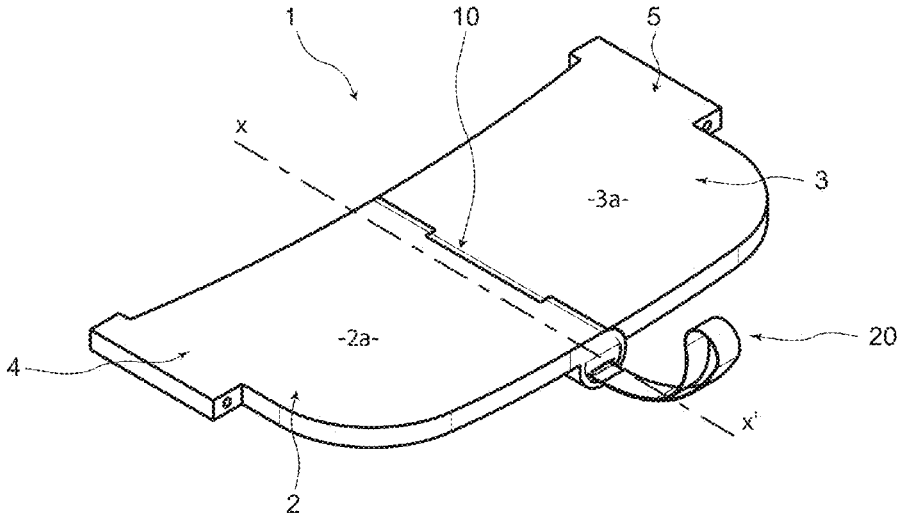
Fig. 1
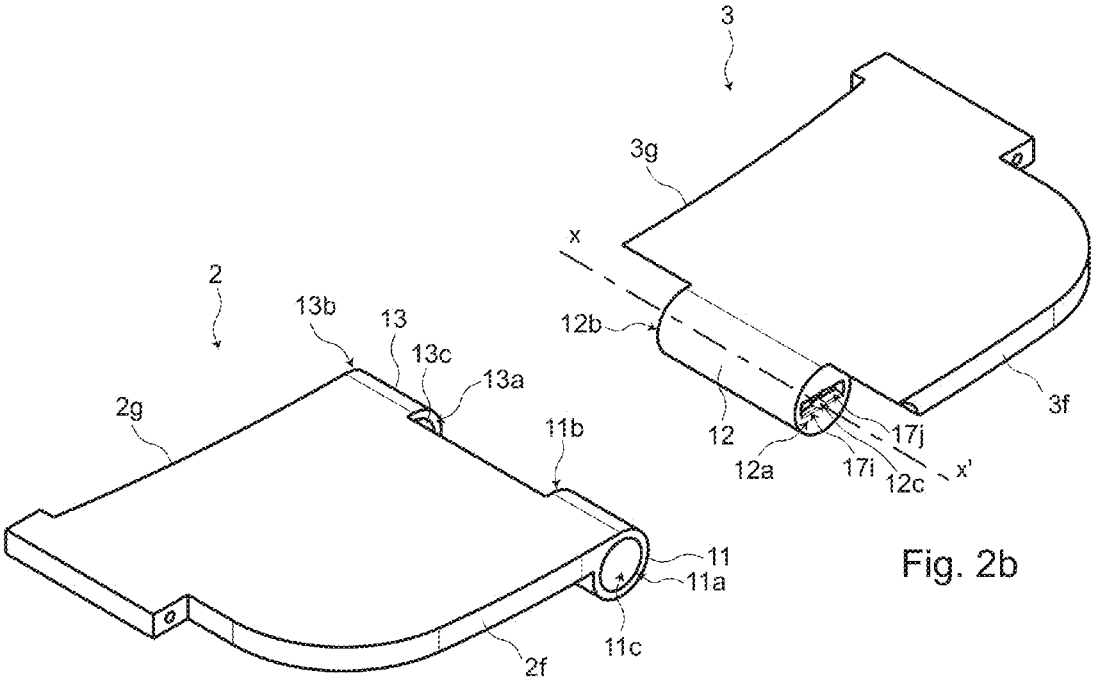
Fig. 2b
Fig. 2a

FOLDABLE SEAT FOR A ROLLATOR OR A WHEELCHAIR

RELATED APPLICATIONS

The present application claims the benefit of European Patent Application No. 11171122.2, filed on Jun. 23, 2011, which is incorporated herein by reference in its entirety.

FIELD OF THE INVENTION

The present invention relates to a foldable seat for a rollator or a wheelchair, said seat being configured so as to be locked and unlocked in at least one position, i.e. an unfolded position and/or a folded position.

BACKGROUND OF THE INVENTION

Conventional collapsible rollators or wheelchairs often use flexible seats made of canvas or similar non-rigid material. However, such seats do not offer the ideally required level of comfort for the user. Thus, rigid foldable seats have been developed. Such seats are generally hinged in their middle to enable the rollators or wheelchairs to be easily folded into a storage position. Therefore, these two-piece seats define at least two positions of use, an unfolded one, in which the pieces are aligned in the same plane, and a folded one, in which the pieces define an angle less than 180°, and preferably, an angle approximately equal to zero.

To prevent these two-piece seats from folding upwardly or downwardly from their unfolded position, it is known by the man skilled in the art to use locking means which prevents the rotation of the two elements forming the seat. It is also known by the man skilled in the art to use unlocking means so as to allow the rotation of the two elements forming the seat from a locked unfolded position. In particular, such locking and unlocking means have been disclosed in the prior art documents U.S. Pat. No. 7,108,004 B2 and EP 1 244 413 B1, which are incorporated herein by reference in their entirety.

In the document U.S. Pat. No. 7,108,004 B2, the seating structure includes a right side support rotatably mounted on the right side frame of a rollator and a left side support rotatably mounted on the left side frame of said rollator. The right side and left side supports are pivotally interconnected by a first hinge extending along the top surface of the right side and left side supports, and a hinged link, in the form of a tension-rod plate, pivotally interconnecting the bottom surfaces of the right and left side supports. The tension-rod plate is comprised of a first and second solid links pivotally connected to the frame of said rollator, said links being interconnecting by a second hinge, which is positioned directly below the first hinge and parallel thereto. Force-transmitting struts extend diagonally downward from either side of the first hinge to proximate the ends of the first and second solid links. In this prior art, the locking means consists in a spring clip extending from the first solid link and one of the force-transmitting struts and the unlocking means consists in a strap, which extends through openings in the first and second solid links, the force-transmitting struts and the right and left side supports, initial force pulling up on the strap disengaging the spring clip, enabling the right and left side support to pivot towards each other. One of the drawbacks of this solution is its relative complexity. Indeed, it implies the use of an additional tension-rod plate positioned below the seating structure itself. Another drawback is the impossibility for the user to lock the seating structure in a folded position. Finally, the presence of the strap above the top surface of the seating structure implies that the seat covers includes a shallow recess for receiving the strap to ensure the strap does not cause discomfort to anyone sitting on the seating structure. Therefore, this solution implies increased production costs. Furthermore, it implies that nobody is sitting in the rollator to unlock the seating structure.

In the document EP 1 244 413 B1, the seating structure of a rollator consists in a foldable or hinge joint platform which takes, in the rolling position, a stretched position in a substantially horizontal plane, halves of said platform being pivotally connected in the vertical plane of symmetry of the rollator and being each pivotally mounted to the assembly of frame tubes on a respective side of the rollator for an upward folding movement. In this prior art, the locking means consists in a substantially Z-shaped locking element, which is resiliently received in a center piece of the platform and extends with its upper flange portion forwardly over the upper end of the central piece. The locking element is provided with a locking cam, which, in the unfolded position of the seating structure, engages a rearwardly extending locking edge of a guide piece, which is positioned under the platform. In this way, the central piece and the guide piece are locked relative to one another, which excludes undesired folding of the rollator. To enable folding of the rollator, the locking element may be simply depressed downwards, as a result of which the locking cam gets disengaged from the locking edge. Like the previous document, one of the drawbacks of this solution is the impossibility for the user to lock the seating structure in a folded position. Another drawback is the risk that an unwanted unlock of the seating structure occurs when the user is sitting on the locking element. Therefore, this solution is relatively unsafe.

The aim of the present invention is therefore to provide a foldable seat for a rollator or a wheelchair, wherein the drawbacks mentioned of the known foldable seat is avoided.

SUMMARY OF THE INVENTION

In this view, the present invention is concerned with a foldable seat for a rollator or a wheelchair, said seat comprising:

- a first rigid plate and a second rigid plate, said plates being adjacently connected along a longitudinal axis so as to be rotatably moveable around said longitudinal axis between an unfolded position, in which their plane surfaces are approximately aligned, and a folded position, in which their plane surfaces define an angle less than 180°, and preferably, an angle approximately equal to zero, said plates being also configured so as to be pivotally connectable to a frame of a rollator or a wheelchair, and
- a hinge pivotally connecting said first plate to said second plate, wherein said hinge comprises at least a first cylinder integral with said first plate, said first plate projecting over said first cylinder, at least a second cylinder integral with said second plate, said second plate projecting over said second cylinder, and a pivot pin extending through axial through-bores and/or apertures of said first and second cylinders, said pin defining said longitudinal axis, wherein said seat further comprises a locking/unlocking system configured to be actuated by hand by the user so as to lock, respectively unlock, said first and second plates into, respectively from, said unfolded position and/or said folded position, said locking/unlocking system being at least partially lodged inside said first and/or said second cylinder.

According to a first embodiment of the invention, the locking/unlocking system of the foldable seat comprises:

a locking element integral in rotation with the first cylinder and lodged at least partially inside an axial aperture formed at a distal end of said first cylinder, said distal end being adjacent to a proximal end of said second cylinder, said locking element being urged by a spring means against said proximal end and comprising a projecting shape which is designed to mate with a corresponding notch formed in said proximal end, and an unlocking element configured to be actuated by hand by the user so as to move said locking element away from said proximal end till said projecting shape is positioned outside of said corresponding notch.

According to a further embodiment of the invention, the locking/unlocking system of the foldable seat comprises:

a locking element integral in rotation with the first cylinder and lodged at least partially inside an axial aperture formed at a distal end of said first cylinder, said distal end being adjacent to a proximal end of said second cylinder, said locking element being urged by a spring means against said proximal end and comprising at least one notch which is designed to mate with a corresponding projecting shape formed in said proximal end, and an unlocking element configured to be actuated by hand by the user so as to move said locking element away from said proximal end till said corresponding projecting shape is positioned outside of said notch.

Important features of the device are defined in the dependent claims.

Thanks to the features of the invention, the plates of the seat may be easily locked or unlocked in their folded and/or unfolded position. Furthermore, in the invention, the locking/unlocking system is lodged at least partially inside the hinge pivotally connecting the plates of the seat. Therefore, the invention confers a simple and compact structure to the seat and avoids that an unwanted unlock of the plates occurs when the user is sitting on the seat.

BRIEF DESCRIPTION OF THE DRAWINGS

Other features and advantages of the present invention will appear more clearly from the detailed description of one embodiment of the invention which is presented solely by way of a non-restricted example and illustrated by the attached drawings in which:

FIG. 1 is a perspective view of a first embodiment of a foldable seat according to the present invention in an unfolded position;

FIGS. 2*a* and 2*b* are, respectively, perspective views of the first and second plates of the seat of FIG. 1;

DETAILED DESCRIPTION OF EMBODIMENTS OF THE INVENTION

In reference to FIG. 1, a foldable seat conforming to the present invention is shown. The seat may be used with a rollator. For example, the seat may be used with the rollators illustrated by U.S. Pat. No. 7,108,004 B2 and/or EP 1 244 413 B1 mentioned above. However, the seat may be used in any rollator and in a variety of other applications. For example, the seat may be attached to a frame of a wheelchair.

Figure 9:
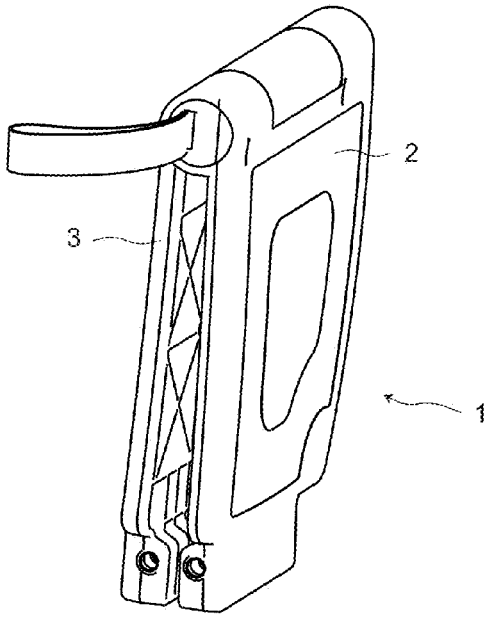
FIG. 9 is a perspective view of the foldable seat of FIG. 1 in a folded position.

The seat 1 comprises a first plate 2 defining an upper plane surface 2*a*, said upper surface 2*a* having an approximately rectangular form, and a second plate 3 defining an upper plane surface 3*a*, said upper surface 3*a* being approximately symmetric to said upper surface 2*a* with respect to a vertical plane passing through a longitudinal axis XX', said first and second plates 2, 3 being pivotally interconnected around said longitudinal axis XX' by a hinge 10. Said first and second plates 2, 3 are also configured so as to be pivotally connectable at their lateral free ends 4, 5 to a frame of a rollator or a wheelchair. In particular, said lateral ends 4, 5 will be advantageously configured so as to receive connecting means for pivotally connecting said first and second plates 2, 3 to said frame. Said plates 2 and 3 are made of a rigid material, preferably in plastics or metal. In the position shown in FIG. 1, the seat 1 is locked in its unfolded position of use, in which the plane surfaces 2*a* and 3*a* of said plates 2 and 3 are approximately aligned. In a further position of the seat, shown in FIG. 9, said plates 2 and 3 may be positioned in a folded position, in which their plane surfaces 2*a* and 3*a* define an angle less than 180°, and, preferably, an angle approximately equal to zero. So as to lock or unlock said plates 2 and 3 in said unfolded and/or folded position, the seat 1 comprises a locking/unlocking system 20, illustrated in greater detail in FIG. 3.

The hinge 10 is illustrated in greater detail in FIG. 2. Said hinge 10 comprises a first cylinder 11 integral with the first plate 2, a second cylinder 12 integral with the second plate 3 and a third cylinder 13 integral with the first plate 2, said first, second and third cylinders being coaxially aligned along the longitudinal axis XX', said second cylinder 12 being disposed between said first and said third cylinders 11, 13 and being rotatably movable with respect to said first and said third cylinders 11, 13 by means of a pivot pin 14, illustrated in FIG. 4 or 6, extending along said longitudinal axis XX' through axial through-bores 11*c*, 12*c* and 13*c* of said first, second and third cylinders respectively. In the embodiment shown, the first plate 2 projects over said first and third cylinders 11, 13 so that the proximal end 11*a* of said first cylinder 11 is approximately aligned with the front side 2*f* of said first plate 2 and the distal end 13*b* of said third cylinder 13 is approximately aligned with the back side 2*g* of said first plate 2. Furthermore, the second plate 3 projects over said second cylinder 12 so that, in the position of use of the seat 1, the proximal end 12*a* of said second cylinder 12 is adjacent to the distal end 11*b* of said first cylinder 11 and the distal end 12*b* of said second cylinder 12 is adjacent to the proximal end 13*a* of said third cylinder 13 and so that, in said position of use of the seat 1, the front side 2*f*, respectively the back side 2*g*, of said first plate 2 is approximately aligned with the front side 3*f*, respectively the back side 3*g*, of said second plate 3.

In a second embodiment (not shown) of the invention, the hinge 10 differs from the first embodiment shown on FIGS. 2*a* and 2*b* by the fact that it comprises only two cylinders, a first one 11 integral with the first plate 2 and a second one 12 integral with the second plate 3. In this embodiment, the first and second cylinders 11, 12 could advantageously be disposed so that the distal end 12*b* of said second cylinder 12 is approximately aligned with the back side 3*g* of the second plate 3 and/or so that said first and second cylinders 11, 12 have approximately the same length.

In a third embodiment (not shown) of the invention, the hinge could also comprise more than three cylinders. In this case, the locking/unlocking system of the seat may advantageously be lodged at least partially inside at least one cylinder of said hinge, so that the unlocking element(s) of said locking/unlocking system is positioned at the periphery of the seat and/or at the exterior of the seat.

Figure 3:
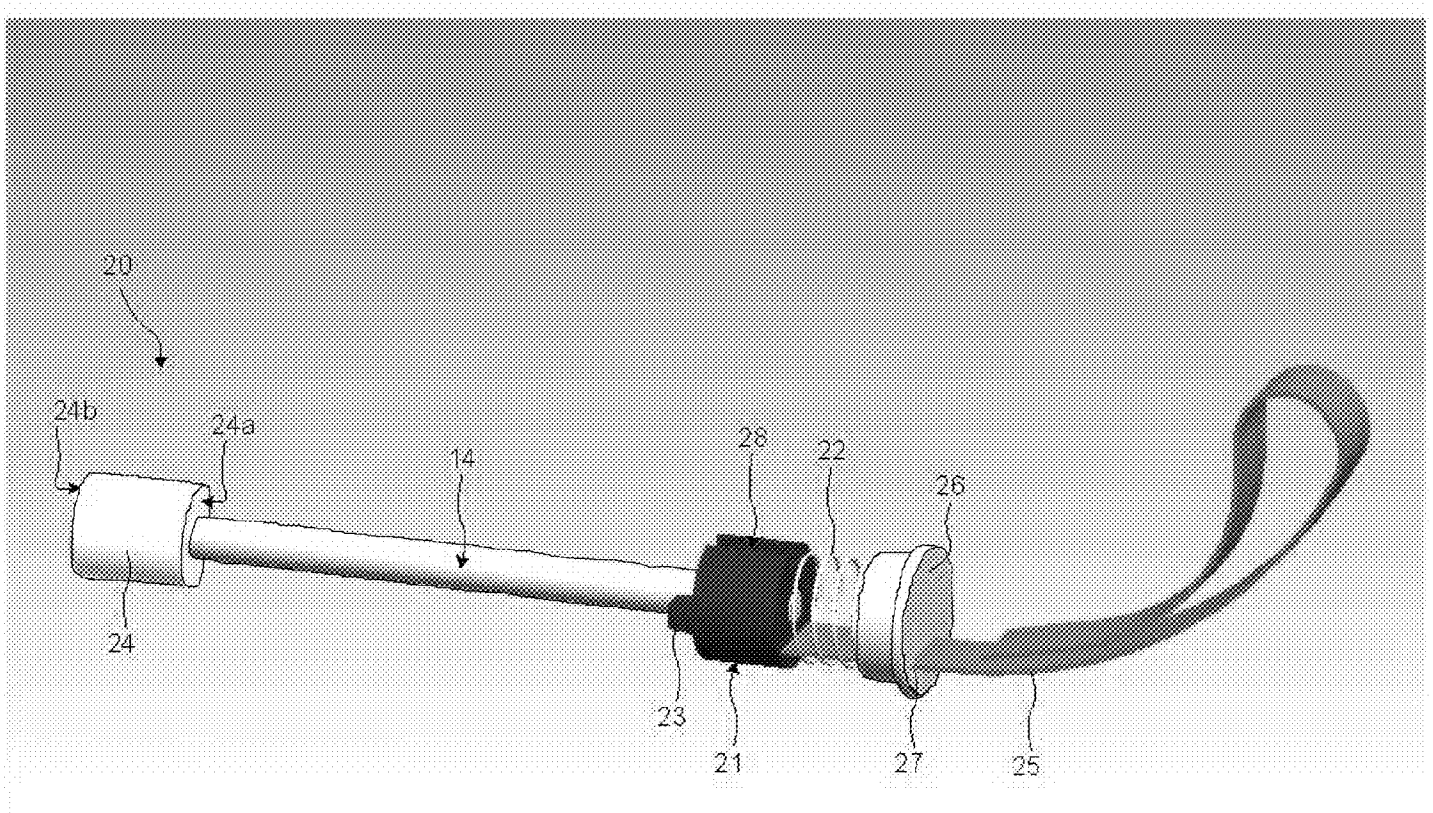
FIG. 3 is a perspective view of the locking/unlocking system of the seat of FIG. 1.

In reference to FIG. 3, a locking/unlocking system conform to the present invention is shown.

Said locking/unlocking system 20 comprises a locking element 21 and two unlocking elements, i.e. a button 24 and a strap 25. However, in a further embodiment (not shown) of the invention, said locking/unlock system 20 may comprise only one unlocking element chosen among said button 24 and said strap 25.

Figure 4:
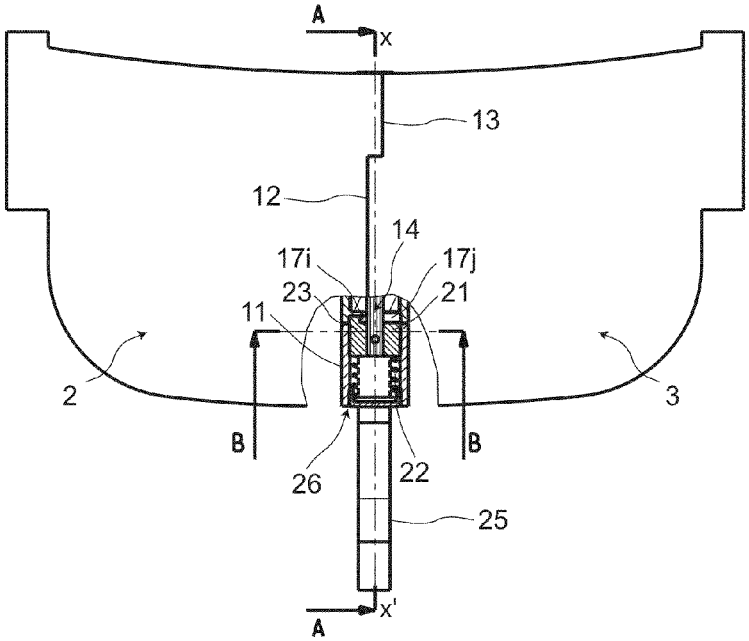
FIG. 4 is a top plan view, partially in cross-section along line C-C of FIG. 5, of the seat of FIG. 1.
Figure 6:
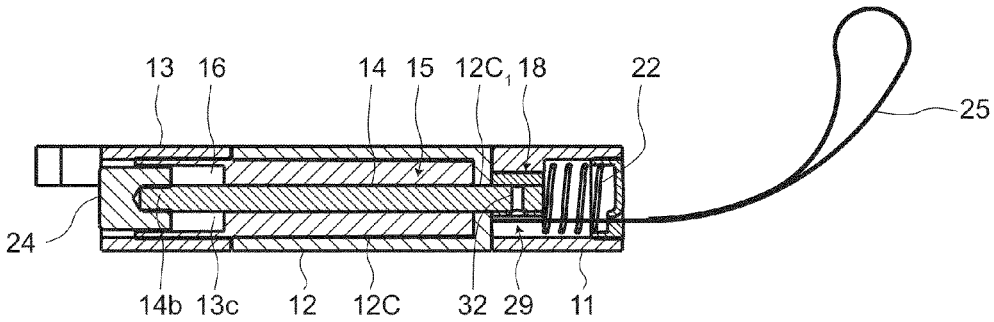
FIG. 6 is a side cross-section view along line A-A of FIG. 4 of the seat of FIG. 1.

The locking/unlocking system 20 is advantageously configured so as to be at least partially lodged inside said hinge 10, so that, in the unfolded position of use of the seat 1, the distal end 24*b* of said button 24 is approximately aligned with the distal end 13*b* of the third cylinder 13, as shown in FIG. 6, or slightly recessed inside the hinge 20 at said distal end 13*b* of said third cylinder 13, and the strap 25 extends at least partially outside of the first cylinder 11 from its proximal end 11*a*, as shown in FIGS. 4 and 6. Thus, said unlocking elements 24 and 25 may be easily actuated by the hand of the user, either by pushing said button 24 along the axial direction XX' or by pulling said strap 25 along the axial direction XX', both actions moving the locking element 21 along the longitudinal axis XX' in the direction going from the back, or distal, side of the seat 1 to the front, or proximal, side of the seat 1. As explained in detail in the following description, this axial motion of the locking element 21 disconnects the second cylinder 12 from the first cylinder 11 and permits a relative rotational movement between said cylinders 11, 12. In addition, said configuration avoids an unwanted unlock of the seat 1, in particular in its unfolded position, due to the hidden position of the button 24 inside the hinge 10, which avoids an unwanted actuation of said button 24.

Figure 7:
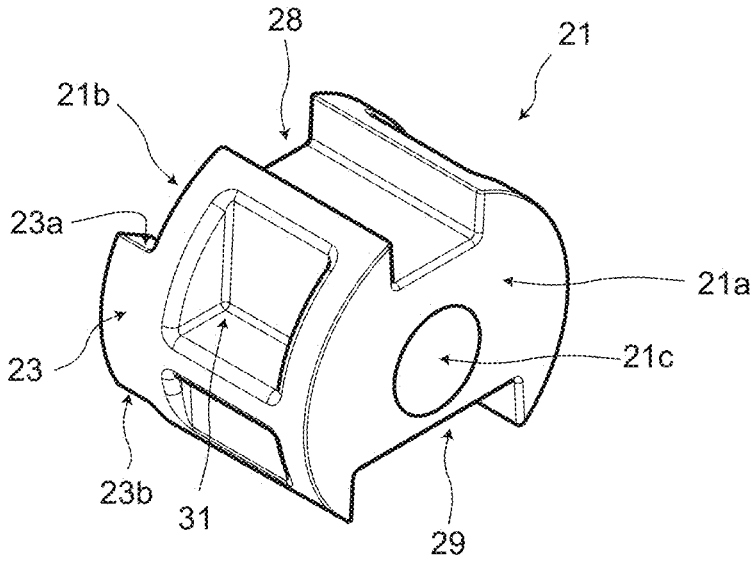
FIG. 7 is a perspective view of the locking element used in the locking/unlocking system of FIG. 3.
Figure 8:
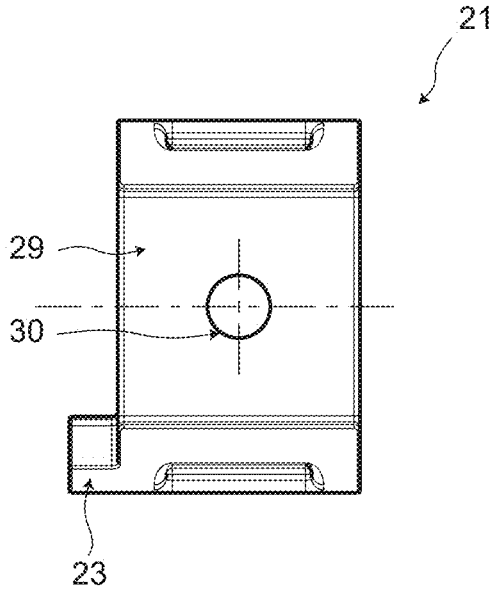
FIG. 8 is an underneath view of the locking element of FIG. 7.

As shown in detail in FIGS. 7 and 8, the locking element 21 has an approximately cylindrical form. It comprises an axial through-bore 21*c* adapted to receive one end of the pivot pin 14. Said end is fixedly connected to said locking element 21 by means of a screw 32 received in corresponding threaded holes formed in said pivot pin 14 and said locking element 21. The threaded hole 30 formed in said locking element 21 leads to a first longitudinal axially-oriented groove 29 in which one end of the strap 25 is received, said end being fixedly connected to the locking element 21 by means of the same screw 32. Several indentations 31 are advantageously formed in the external cylindrical surface of the locking element 21 so as to lodge dirt or debris during use. A second longitudinal axially-oriented groove 28 is also formed in said external surface, said groove 28 being designed to mate with a projecting shape 18 formed in the internal cylindrical surface of an axial aperture 11*c* formed at the distal end 11*b* of said first cylinder 11, thus permitting a sliding axially-oriented relative motion of said locking element 21 with respect to said first cylinder 11 and rendering said locking element 21 integral in rotation with said first cylinder 11. At its distal end 21*b*, said locking element 21 comprises a projecting shape 23 which is designed to mate with a corresponding notch 17*i* or 17*j*, see in particular FIGS. 2*b* and 4, formed in the proximal end 12*a* of the second cylinder 12, thus rendering said locking element 21 integral in rotation with said second cylinder 12 and locking said seat in its unfolded position or folded position. In particular, when the seat 1 is in its locked unfolded, respectively folded, position, said projecting shape 23 abuts against the bottom of the notch 17*i*, respectively 17*j*, and the upper end 23*a* and lower end 23*b* of said projecting shape 23 is very close to the upper side and lower side of said notch 17*i*, respectively the lower side and upper side of said notch 17*j*. In the embodiment shown, said notches 17*i* and 17*j* are separated by the axial through-bore 12*c* of the second cylinder 12 and are approximately symmetrical with regard to the longitudinal axis of said second cylinder 12, corresponding to the longitudinal axis XX' in the position of use of the seat. In this configuration, the plane surfaces 2*a* and 3*a* of said first plates 2 and 3 define an angle approximately equal to zero when the seat 1 is in its locked folded position. However, in a further embodiment (not shown) of the invention, said plane surfaces 2*a* and 3*a* may define an angle higher to zero, but less than 180°, in the locked folded position of the seat when said notch 27*j* is not symmetrical to said notch 27*i* with regard to the longitudinal axis of said second cylinder 12. In addition, in the embodiment shown, said notch 27*j* is deeper than said notch 27*i*. In this configuration, the distal end 24*b* of the button 24 will be positioned, in the locked folded position of the seat, slightly outside of the hinge 20 at the distal end 13*b* of the third cylinder 13 so as to ease the accessibility to said button 24. However, in further embodiments (not shown) of the invention, said notch 27*j* may have the same depth as said notch 27*i*, or may be less deep than said notch 27*i*, or, finally, only one notch 27*i* or 27*j* is formed in the proximal end 12*a* of the second cylinder 12. In this last configuration, the seat 1 could only be locked in one position, i.e. an unfolded one or a folded one. In a further embodiment (not shown) of the invention, said notch 27*i* and/or 27*j* may be formed in the distal end 21*b* of the locking element 21 and the corresponding projecting shape 23 may be formed in the proximal end 12*a* of the second cylinder 12. In a preferred configuration of said embodiment, the positions of said projecting shape 23 and said notch 27*i* and/or 27*j* may be symmetrical to their positions in the embodiment illustrated in FIGS. 1 to 8 with regard to a plane perpendicular to the longitudinal axis XX'.

Figure 5:
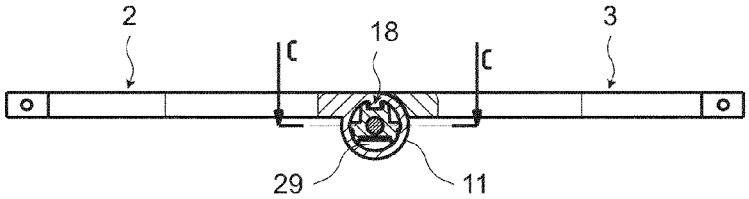
FIG. 5 is a front view, partially in cross-section along line B-B of FIG. 4, of the seat of FIG. 1.

As shown in detail in FIGS. 4 to 6, the locking element 21 is lodged at least partially inside an axial aperture 11*c* formed at the distal end 11*b* of the first cylinder 11, said distal end 11*b* being adjacent to the proximal end 12*a* of the second cylinder 12. In the configuration shown, said axial aperture 11*c* corresponds to an axial through-bore of said first cylinder 11, said axial through-bore being closed at the proximal end 11*a* of said first cylinder 11 by a lid 26 fixedly connected to said first cylinder 11. Said locking element 21 is urged against the proximal end 12*a* of the second cylinder 12 by a spring means 22. In the configuration shown, the spring means consists in a compression spring 22 lodged inside said axial aperture 11*c*, the ends of said spring 22 abutting against the proximal end 21*a* of said locking element 21 and the internal side of said lid 26. As shown in FIG. 3, said lid 26 includes a slot 27 through which the strap 26 may extend. So as to fixedly connect the button 24 to the pivot pin 14, the distal end 14*b* of said pivot pin 14 may be advantageously screwed inside a threaded hole formed in the proximal end 24*a* of said button 24. In the configuration shown in FIG. 6, said button 24 is received inside an axial aperture 16 formed at the distal end of an intermediate cylinder 15 lodged inside the hinge 10 and extending partially through an axial through-bore 13*c* of the third cylinder 13 and an axial through-bore 12*c* of the second cylinder 12, said axial through-bore 12*c* having a narrower proximal end 12*c*1 adapted to receive the pivot pin 14. The bottom of said aperture 16 forms a stop against which said button 14 abuts, thus limiting the axial motion of the locking element 21 and avoiding that the projecting shape 18 is positioned outside of the groove 28. In a further embodiment (not shown) of the invention, said button 24 may also be received inside an axial aperture formed at a distal end 13*b* of said third cylinder 13, the bottom of said aperture forming also a stop against which said button 14 abuts.

The above detailed configuration of the first embodiment of the invention illustrated in FIGS. 1 to 9 could easily be adapted to the above mentioned second and third embodiments of the invention. In particular, the configuration illustrated in FIG. 6 could easily be adapted to the second embodiment by cancelling the separation between the second and the third cylinders and by designating this combined cylinder as the second cylinder 12. In the same way, the configuration in FIG. 6 could easily be adapted to the third embodiment by adding further separations in the second and/or third cylinders and by designating the cylinder inside which is lodged the button as the third cylinder and the cylinder inside which is formed the notches as the second cylinder.

Figure 10:
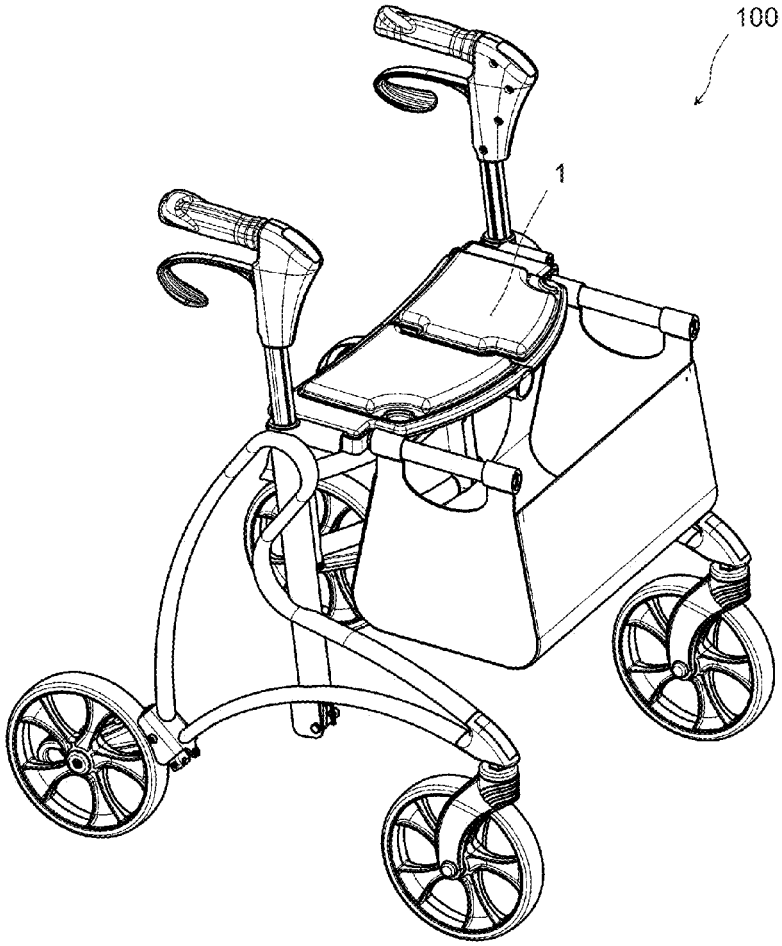
FIG. 10 is a perspective view of a rollator comprising a foldable seat conform to the present invention.

In reference to FIG. 10, a rollator 100 comprising a foldable seat 1 conform to the present invention is shown.

Figure 11:
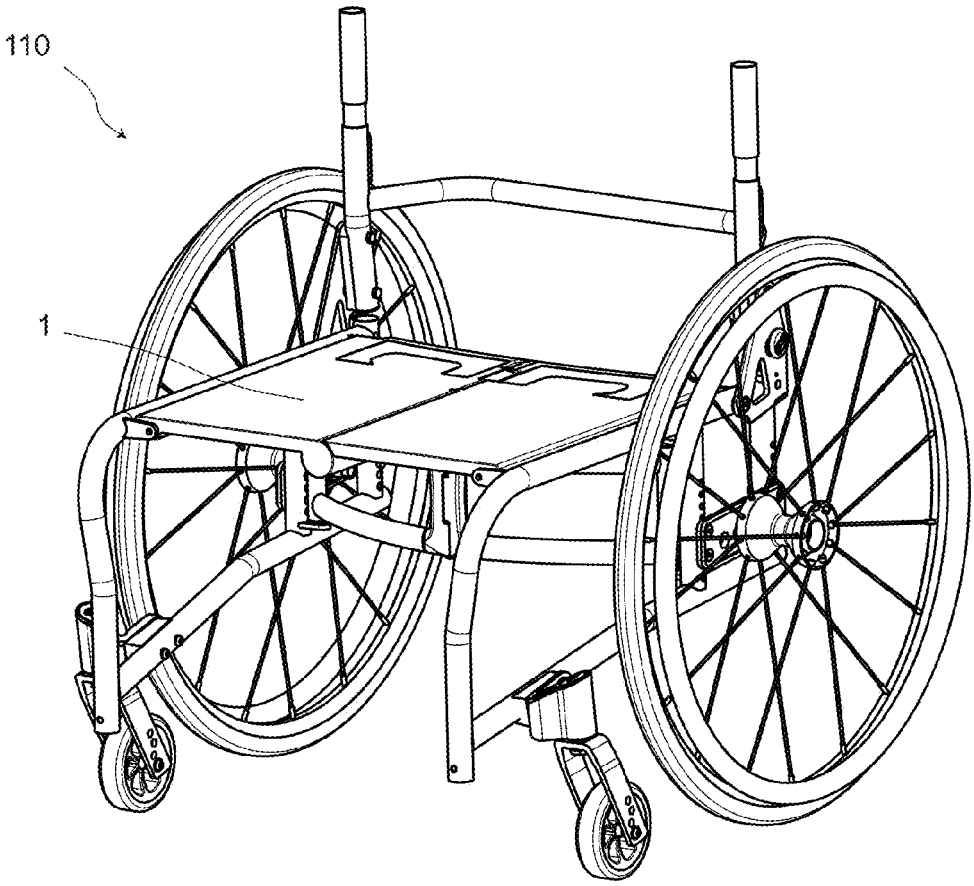
FIG. 11 is a perspective view of a wheelchair frame comprising a foldable seat conform to the present invention.

In reference to FIG. 11, a wheelchair 110 comprising a foldable seat 1 conform to the present invention is shown.

The invention claimed is:

1. Foldable seat for a rollator or a wheelchair, said seat comprising:

a first rigid plate and a second rigid plate, said plates being adjacently connected along a longitudinal axis so as to be rotatably moveable around said longitudinal axis between an unfolded position, in which their plane surfaces are approximately aligned, and a folded position, in which their plane surfaces define an angle less than 180°, said plates being also configured so as to be pivotally connectable to a frame;

a hinge pivotally connecting said first plate to said second plate, wherein said hinge comprises at least a first cylinder integral with said first plate, said first plate projecting over said first cylinder, at least a second cylinder integral with said second plate, said second plate projecting over said second cylinder, and a pivot pin extending through axial through-bores and/or apertures of said first and second cylinders, said pin defining said longitudinal axis;

wherein said seat further comprises a locking/unlocking system configured to be actuated by hand by the user so as to lock, respectively unlock, said first and second plates into, respectively from, said unfolded position and/or said folded position, said locking/unlocking system being at least partially lodged inside said first and/or said second cylinder;

wherein said locking/unlocking system comprises:

a locking element integral in rotation with the first cylinder and lodged at least partially inside an axial aperture formed at a distal end of said first cylinder, said distal end being adjacent to a proximal end of said second cylinder, said locking element being urged by a spring means against said proximal end and comprising a projecting shape which is designed to mate with a corresponding notch formed in said proximal end; and an unlocking element configured to be actuated by hand by the user so as to move said locking element away from said proximal end till said projecting shape is positioned outside of said corresponding notch.

2. Foldable seat according to claim 1, wherein at least two notches are formed in the proximal end of the second cylinder, a first one being configured so as to receive said projecting shape when said first and second plates are positioned in their unfolded position and a second one being configured so as to receive said projecting shape when said first and second plates are positioned in their folded position.

3. Foldable seat according to claim 2, wherein said first and second notches are approximately symmetrical with regard to the longitudinal axis.

4. Foldable seat according to claim 3, wherein said first and second notches are separated by an axial through-bore of the second cylinder.

5. Foldable seat according to claim 1, wherein said unlocking element comprises a button fixedly connected to one end of said pivot pin, the other end of said pivot pin being fixedly connected to said locking element, so that, when the user pushes the button along the axial direction, said locking element is moved away from the proximal end of the second cylinder.

6. Foldable seat according to claim 5, wherein said button is received inside an axial aperture formed at a distal end of the second cylinder, said button being configured so that a distal end of said button is approximately aligned with said distal end of said second cylinder when said first and second plates are locked in their unfolded or folded position.

7. Foldable seat according to claim 5, wherein said button is received inside an axial aperture formed at a distal end of a third cylinder integral with said first plate, said first plate projecting over said third cylinder, said third cylinder being axially aligned with said first and said second cylinders and said second cylinder being disposed between said first and said third cylinders, said button being configured so that a distal end of said button is approximately aligned with said distal end of said third cylinder when said first and second plates are locked in their unfolded or folded position.

8. Foldable seat according to claim 1, wherein said unlocking element comprises a strap fixedly connected at one of its end to said locking element and extended at least partially outside of the first cylinder from a proximal end of said first cylinder, so that, when the user pulls said strap along the axial direction, the locking element is moved away from the proximal end of the second cylinder.

9. Foldable seat according to claim 8, wherein said strap extends through a slot formed in a lid fixedly connected at the proximal end of said first cylinder, said lid closing the axial aperture of said first cylinder inside which the locking element is at least partially lodged.

10. Foldable seat according to claim 9, wherein the spring means consists in a compression spring lodged inside said axial aperture of said first cylinder, the ends of said spring abutting against said locking element and said lid respectively.

11. Foldable rollator or wheelchair comprising a foldable seat according to claim 1.

12. Foldable seat according to claim 1 wherein said angle defined by the plane surfaces in the folded position is approximately equal to zero.

13. Foldable seat according to claim 1 wherein said plates are pivotally connectable to a frame of a rollator or a wheelchair.

14. Foldable seat for a rollator or a wheelchair, said seat comprising:

a first rigid plate and a second rigid plate, said plates being adjacently connected along a longitudinal axis so as to be rotatably moveable around said longitudinal axis between an unfolded position, in which their plane surfaces are approximately aligned, and a folded position, in which their plane surfaces define an angle less than 180°, said plates being also configured so as to be pivotally connectable to a frame;

a hinge pivotally connecting said first plate to said second plate, wherein said hinge comprises at least a first cylinder integral with said first plate, said first plate projecting over said first cylinder, at least a second cylinder integral with said second plate, said second plate projecting over said second cylinder, and a pivot pin extending through axial through-bores and/or apertures of said first and second cylinders, said pin defining said longitudinal axis;

wherein said seat further comprises a locking/unlocking system configured to be actuated by hand by the user so as to lock, respectively unlock, said first and second plates into, respectively from, said unfolded position and/or said folded position, said locking/unlocking system being at least partially lodged inside said first and/or said second cylinder;

wherein said locking/unlocking system comprises:

a locking element integral in rotation with the first cylinder and lodged at least partially inside an axial aperture formed at a distal end of said first cylinder, said distal end being adjacent to a proximal end of said second cylinder, said locking element being urged by a spring means against said proximal end and comprising at least one notch which is designed to mate with a corresponding projecting shape formed in said proximal end; and an unlocking element configured to be actuated by hand by the user so as to move said locking element away from said proximal end till said corresponding projecting shape is positioned outside of said notch.

15. Foldable seat according to claim 14, wherein at least two notches are formed in the locking element, a first one being configured so as to receive said projecting shape of said second cylinder when said first and second plates are positioned in their unfolded position and a second one being configured so as to receive said projecting shape when said first and second plates are positioned in their folded position.

16. Foldable seat according to claim 15, wherein said first and second notches are approximately symmetrical with regard to the longitudinal axis.

17. Foldable seat according to claim 16, wherein said first and second notches are separated by an axial through-bore of the locking element, said through-bore being configured to receive one end of the pivot pin.

18. Foldable seat according to claim 14, wherein said unlocking element comprises a button fixedly connected to one end of said pivot pin, the other end of said pivot pin being fixedly connected to said locking element, so that, when the user pushes the button along the axial direction, said locking element is moved away from the proximal end of the second cylinder.

19. Foldable seat according to claim 18, wherein said button is received inside an axial aperture formed at a distal end of the second cylinder, said button being configured so that a distal end of said button is approximately aligned with said distal end of said second cylinder when said first and second plates are locked in their unfolded or folded position.

20. Foldable seat according to claim 18, wherein said button is received inside an axial aperture formed at a distal end of a third cylinder integral with said first plate, said first plate projecting over said third cylinder, said third cylinder being axially aligned with said first and said second cylinders and said second cylinder being disposed between said first and said third cylinders, said button being configured so that a distal end of said button is approximately aligned with said distal end of said third cylinder when said first and second plates are locked in their unfolded or folded position.

21. Foldable seat according to claim 14, wherein said unlocking element comprises a strap fixedly connected at one of its end to said locking element and extended at least partially outside of the first cylinder from a proximal end of said first cylinder, so that, when the user pulls said strap along the axial direction, the locking element is moved away from the proximal end of the second cylinder.

22. Foldable seat according to claim 21, wherein said strap extends through a slot formed in a lid fixedly connected at the proximal end of said first cylinder, said lid closing the axial aperture of said first cylinder inside which the locking element is at least partially lodged.

23. Foldable seat according to claim 22, wherein the spring means consists in a compression spring lodged inside said axial aperture of said first cylinder, the ends of said spring abutting against said locking element and said lid respectively.

24. Foldable rollator or wheelchair comprising a foldable seat according to claim 14.

25. Foldable seat according to claim 14 wherein said angle defined by the plane surfaces in the folded position is approximately equal to zero.

26. Foldable seat according to claim 14 wherein said plates are pivotally connectable to a frame of a rollator or a wheelchair.

* * * * *